US005141231A

United States Patent [19]

Cox

[11] Patent Number: 5,141,231

[45] Date of Patent: Aug. 25, 1992

[54] GOLF CLUB FACE SHIELD

[75] Inventor: A. Paul Cox, Fort Worth, Tex.

[73] Assignee: Elizabeth Ann Martin, Corsicana, Tex.

[21] Appl. No.: 627,268

[22] Filed: Dec. 14, 1990

[51] Int. Cl.[5] ..... A63B 53/00

[52] U.S. Cl. ..... 273/173

[58] Field of Search ..... 273/173

[56] References Cited

U.S. PATENT DOCUMENTS 3,368,812 2/1968 Baldwin ..... 273/173 X 3,989,248 11/1976 Campau ..... 273/173 X

FOREIGN PATENT DOCUMENTS 267755 3/1927 United Kingdom ..... 273/173

*Primary Examiner*—William H. Grieb

*Attorney, Agent, or Firm*—James E. Bradley

[57] ABSTRACT

A shield is provided for covering the face of a golf club of the type known as a wood wherein the shield comprises a metallic plate, having the general shape and size to substantially cover a given golf club face; the shield may further comprise a bonding layer sandwiched between the metallic plate and the golf club face for filling voids therebetween and for imparting a cushioning and resilience effect. The shield may be attached to the face of the golf club either by the epoxy bonding layer itself, with adequate adhesive strength to retain the metallic shield, or by pinning devices such as screws, nails, or tacks penetrating through the metallic plate and into the club face. The shield can be of uniform thickness or it can have thickness gradient from one edge to the other for altering the directivity of the club. Specifically, it can have a top-to-sole gradient for changing loft characteristics or it can have a heel-to-toe gradient to counteract horizontal spin and thereby offset a slice or a hook tendency of the club.

22 Claims, 3 Drawing Sheets

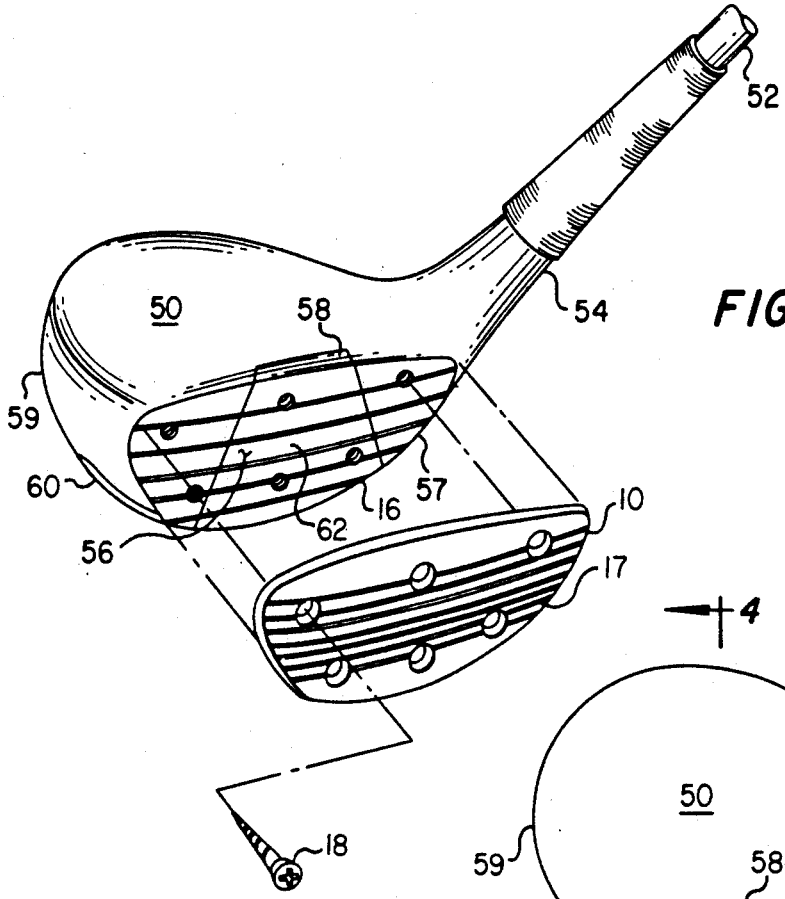
FIG. 1
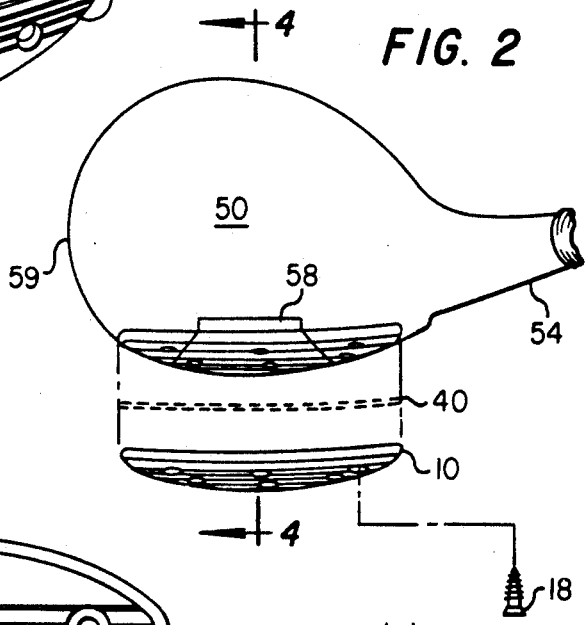
FIG. 2
FIG. 3a
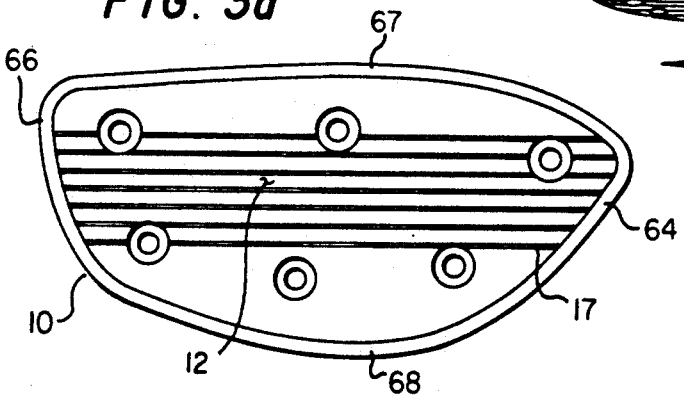
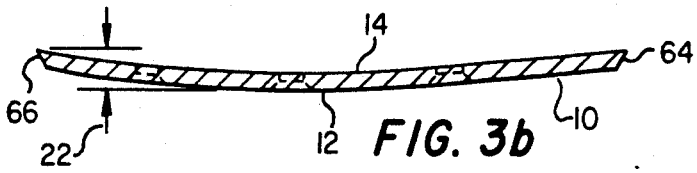
FIG. 3b
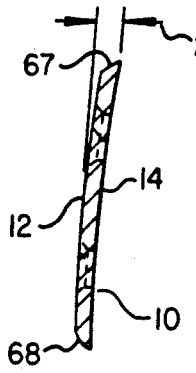
FIG. 3c

GOLF CLUB FACE SHIELD

BACKGROUND OF THE INVENTION

1. Field of the Invention:

This invention relates generally to the field of golf clubs and more particularly to their construction and repair. Still more particularly, it relates to a device for repairing damaged faces of, and for improving the ball hitting characteristics of, wooden golf clubs.

2. Description of the Prior Art:

Golf clubs have existed and been in continuous use since the game of golf was invented in Scotland many decades ago. Conventional wisdom suggests that a player use a set of clubs comprising two types: a plurality of "irons" numbered in increasing sequence to reflect shorter shaft lengths and club faces increasingly tilted from the vertical to increase the height of ball flight, and a plurality of "woods" having greater mass and length than irons with a similar but usually smaller array of faces. Irons serve most usefully for shorter shots, usually on the fairway, while woods perform better for greater distances both from the tee and on the fairway.

By far the most important factor affecting ball flight is the skill and strength of the golfer when swinging the golf club. Because of the popularity of the game, however, numerous efforts have been made to improve the hitting characteristics and overall performance of golf clubs in the hands of professionals and amateurs alike. Considerable effort especially has been dedicated to improving the hitting characteristics of woods.

A golf club of the type known as a wood typically has a striking surface, or "face," located on one side of the head. Though the face of a wood appears flat, it is typically curved slightly outward at its center, forming an ideal striking spot, known as the "sweet spot," which theoretically comprises the focal point of all factors affecting ball travel. This curvature of the face exists in both vertical and horizontal planes passing through and intersecting at the sweet spot, the horizontal curvature being known as the "bulge," and the vertical curvature being known as the "roll," of the face. A ten inch radius for both bulge and roll is considered standard, though each may range from 8 inches to 14 inches.

The intended ball flight direction normally will be an extension of an imaginary line through the center of gravity of the club head and exiting the club face at the sweet spot. This imaginary line, or "strike line," is substantially perpendicular to the club shaft and parallel to the bottom, or "sole," of the club head, and it is normal to a vertical projection of the face in an imaginary plane formed perpendicular to the sole. This imaginary plane is ordinarily oriented at a predetermined angle relative to the shaft that takes into account shaft flex during the swing. An "open" faced club's imaginary plane deviates from a parallel orientation relative to the shaft whereby its toe edge is closer to the unflexed shaft axis than its heel edge. A "closed" club face has its heel edge closer to the shaft axis than its toe edge.

Deviation in the tilt of the club face from its vertical projection defines the "loft" of the club face. Increased loft induces greater height into the flight path of the ball above the ground. Standard loft for a "driver," the largest wood used for the longest, flattest ball flight arc, is 11 degrees, though loft may range from 7 or 8 degrees up to 13 degrees. Wood sets typically have 2–3 degrees of additional loft on successive clubs.

Surface rebound characteristics of the club face also affect ball flight, especially in the vicinity of the sweet spot. A trapezoidal shaped wedge of material called an "insert" usually is inlaid into the face covering the region around the sweet spot. An insert allows the manufacturer to provide what that manufacturer considers ideal sweet spot characteristics. Typically, the face will be striated to increase friction in all potential ball contact points using horizontal grooves across the entire face, including the insert.

A spectrum of theories exists about the ideal makeup of the insert. Insisting that the insert should be softer than the rest of the club, patents expound methods and materials to achieve such inserts, typified by Homma, U.S. Pat. No. 4,812,187, and McKee, U.S. Pat. No. 4,804,188. Orlowski illustrates the contrary theory in U.S. Pat. No. 4,749,197, which claims a titanium insert harder than the typical wooden golf club head, thereby imparting additional impetus to the ball derived from the increased elasticity of the strong metal surface. Further, though it is known in the art to resurface the entire face of a club with a plate intended to harden or soften hitting characteristics of more than just the sweet spot (Jepson discloses just such an approach in U.S. Pat. No. 3,937,474), it would be useful to a club manufacturer to have a more efficient means for altering the surface characteristics of club faces.

The ideal golf swing forms an arc to which the strike line forms a tangent touching the swing arc at the sweet spot. If the strike line continues through the center of gravity of the golf ball when the ball is struck by the club face, the ball travels in a flight arc above the ground. This arc lies in a plane defined by the strike line and a "loft line" normal to the tilted club face, the loft line also radiating from the sweet spot. Because of the angle between the sole and the club shaft, known as the "lie" of the club, this ball travel plane should be vertical even though the swing arc is not. Assuming no crosswind, the golfer can theoretically forecast the ball's direction of travel as the intersection of the ball travel plane with the ground. In other words, the projection of the flight arc onto the ground defines the direction of travel along the fairway of the golf ball in flight.

The foregoing also assumes no horizontal ball spin. The ideal swing causes the club face to strike the ball without inducing any horizontal spin in the ball during flight. Horizontal spin occurs where the tangent to the swing arc is not perpendicular to the vertical projection of the club face. Assuming the golfer does not intend such an effect, it usually occurs when the golfer fails to hold the club properly or lets it slip in his hand during his swing. If the club face were turned such that the tangent of the arc were again normal to the club face, the ball would travel in a different direction than intended, but it would still travel in a vertical arc. In the horizontal spin problem, however, the club face remains perpendicular to the intended line of travel, but the swing arc traverses the intended line of travel rather than aligning with it.

The ball begins its flight in the proper direction, but horizontal spin induces a horizontal curve into what should otherwise be a flat, vertical arc above the ground. The ground projection of this horizontal curve is an arc deviating to the left or right of the intended ground line travel direction. Assuming the golfer uses right handed clubs, the intended direction of ball travel lies to the golfer's left, and the face is oriented substantially to his left, when the golfer addresses the ball in preparation for swing. As the golfer begins, he swings the club head to his right and over his right shoulder to a point, then begins a forward swing arc designed to strike the ball with the club face exactly at the sweet spot. A forward swing arc that begins too close to the golfer will cross the intended ball travel line behind the ball and in a direction away from the golfer, thereby inducing counterclockwise spin (as viewed from above) that causes the ball to "hook" to the left of the intended direction of travel. Conversely, a "slice" occurs when the clockwise horizontal spin is induced by a swing arc begun too far away from the golfer.

Golfers occasionally break or bend the shaft of their favorite club, or they wish to increase or decrease shaft flex to achieve better performance. When changing shaft flex of an existing club, the repairs must take into account any shift in face orientation resulting from the new shaft. As the golfer begins his forward swing, the shaft bends into a curvature with the head trailing the unflexed shaft axis. As the swing continues, this curvature straightens out due to the resilience of the shaft itself. At the moment of impact with the ball, the head may have actually caught up with or even passed the shaft axis depending upon the speed and strength of the golfer's hands throughout the swing. At the moment of impact with the ball, the club head should be traveling at its greatest speed, and the shaft should remain flexed in an amount which presents to the ball the face oriented perpendicular to the intended direction of ball travel.

To achieve such proper presentation, the face must be open or closed sufficiently from a parallel orientation relative to the shaft. If a repairer has changed shaft flex, he probably will need to shift the face orientation accordingly. This usually requires "refacing," or sanding down the face to open or close it relative to its original configuration. The adjustment is an irrevocable judgment call when sanding removes wood from the face. A need thus exists for a more efficient means for adjusting a face that is not irrevocable and that simplifies incremental refacing adjustments.

In some golfer's hands, a given golf club consistently produces a hook or a slice. In fact, in some golfers' hands, any club consistently does so. Obviously, it would be preferable for such golfers to relearn what may be long established swing habits to correct whatever error they consistently make. Such efforts do not always meet with complete success, however, and equipment alterations sometimes achieve what tutoring cannot. Consequently, a need often arises for a means for modifying a golf club to counteract undesired tendencies of the club in a given golfer's hands. A golfer may desire alterations to offset hook or slice tendencies, or to change the loft of his existing club.

A golf club may also be custom manufactured with a "hook face" or a "slice face" to offset a slice or hook habit of a given golfer. Ordinarily, a club manufacturer purchases a wooden club head "blank" having the general shape of a wood club, including a face already cut to a given loft. The manufacturer fabricates and installs the sole plate, obtains and installs the insert, including routing a recess for the insert unless the club blank was purchased at extra cost already routed, and drills the "hosel" where the shaft attaches. Variations in each of these fall within the club manufacturer's discretion in light of the type of club he produces or for whom he makes it. If he wishes to alter the loft, hook or slice characteristics of the club head blank, the club manufacturer must drill the hosel at different angles to orient the face accordingly.

Such drilling, however, is limited in scope and usually must be supplemented with sanding the face. Sanding itself can create problems, especially where a hook face is sought, because the heel edge of the face must be cut away to shift the effective plane of the face to a more closed angle. A common hazard in this process is the likelihood of cutting into the hosel, creating a weak point in the club. The process usually requires a skilled craftsman performing a tailored job. A need exists for a device to shift the face angle as a separate step to greatly simplify drilling the hosel. Further, a need exists for a device that relieves the manufacturer of the need for sanding to achieve the proper face angle, to speed the manufacturing process and to reduce the risk of weakening the club.

Through use, woods frequently suffer from damage. Ideally, the ball will be struck at the center of the sweet spot, but more frequently than not, other parts of the club face become involved in a shot. The club head may strike the ground or other hard objects near the ball. Damage can take the form of nicks and erosion of the shape or finish of the golf club around the perimeter of the head. With age, wooden golf clubs dry out, the lacquer finish erodes away, grooves widen, and shrinkage, warping and cracks occur. Such damage lessens the usefulness of the club to the point that it must be replaced. This can be quite expensive in the case of custom clubs for experienced golfers, and matching an existing set of clubs with a replacement club can be difficult for any golfer. A need exists for a convenient, inexpensive and reliable means for repairing the face of woods to prevent damage during use, to increase the longevity of a new club, and to extend the life of a used club in need of repair.

SUMMARY OF THE INVENTION

Accordingly, it is an object of this invention to provide a shield that protects the face of a golf club.

It is another object of this invention to provide a means of repairing damage to the face of the golf club.

It is yet another object of this invention to provide a means for counteracting hooking and slicing tendencies of a golf club in a given golfer's hands, and for adjusting the loft of a club.

It is yet another object of this invention to provide a means of improving or adjusting the surface rebound characteristics of a golf club.

Other objects of the present invention will become apparent from further explanation in the following detailed description and claims.

A shield is provided for covering the face of a golf club of the type known as a wood wherein the shield comprises a metallic plate having the general shape and size to substantially cover a given golf club face. The shield may further comprise a bonding layer sandwiched between the metallic plate and the club face for filling voids therebetween and for imparting a cushioning and resilience effect. The shield may be attached to the face of the golf club either by the bonding material itself, with adequate adhesive strength to retain the metallic plate, or by some pinning device such as screws, nails, or tacks penetrating through the metallic plate and into the club face. The shield can be of uniform thickness or it can have a thickness gradient from one edge to the other for altering the directivity of the club. Specifically, it can have a top-to-sole gradient for changing loft characteristics or it can have a heel-to-toe gradient to counteract horizontal spin and thereby offset a slice or a hook tendency of the club.

DESCRIPTION OF THE DRAWINGS

The novel features believed characteristic of the invention are set forth in the appended claims. The invention itself, as well as a preferred mode of use and further objects and advantages thereof, will best be understood by reference to the following detailed description of the illustrated embodiment when read in conjunction with the accompanying drawings wherein:

FIG. 1 is a perspective view of a wooden golf club showing a shield in exploded fashion and constructed in accordance with this invention.

FIG. 2 is a plan view of the wooden golf club of FIG. 1 showing the same exploded arrangement.

FIG. 3*a* is a front view of the shield of FIG. 1, showing details of one embodiment of the invention having attachment screws and grooves. FIG. 3*b* is a plan view of the shield of FIG. 3*a*, showing the bulge curvature of the shield. FIG. 3*c* is a side edge view of FIG. 3*a*, showing the roll curvature of the shield.

DESCRIPTION OF THE PREFERRED EMBODIMENT

Figure 4A:
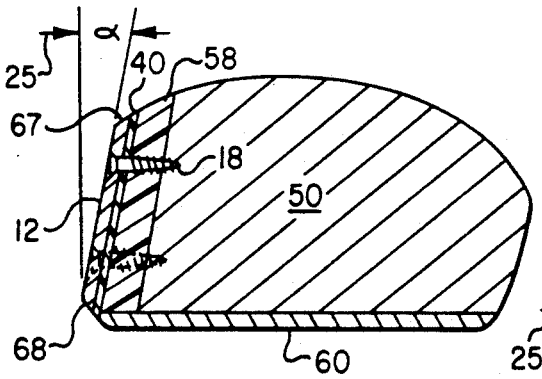
FIGS. 4*a*—4*c* show cross sections through the golf club head of FIG. 1, taken along the line 4—4 of FIG. 2, and showing three embodiments of the metallic shield of this invention and having alternative fixed, increasing and decreasing loft characteristics, respectively.
Figure 4C:
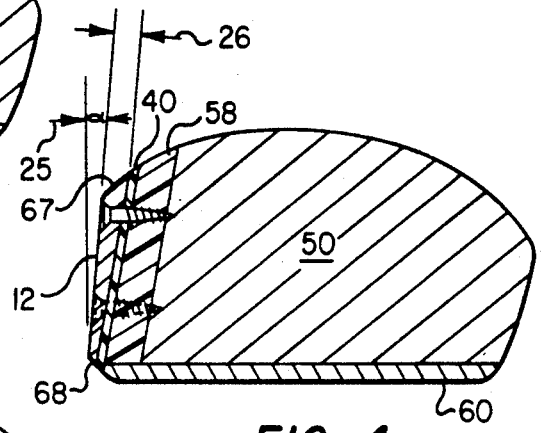
Figure 4B:
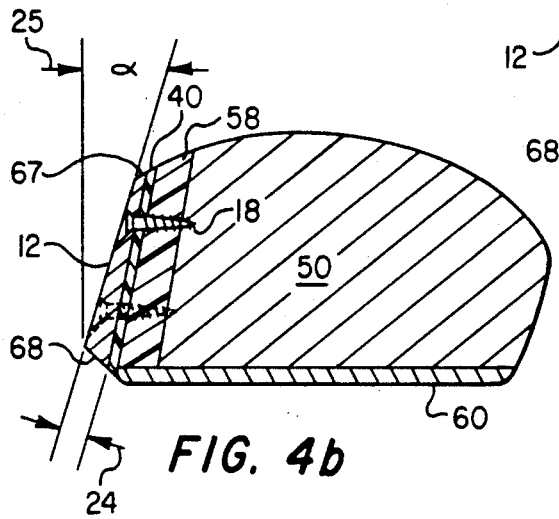
Figure 5:
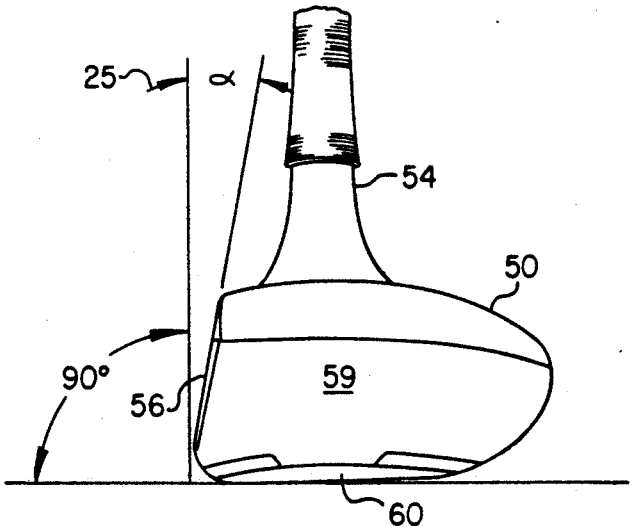
FIG. 5 (PRIOR ART)
FIG. 5 is a toe end elevation of a typical prior art wood, showing the loft angle of its face.
Figure 6A:
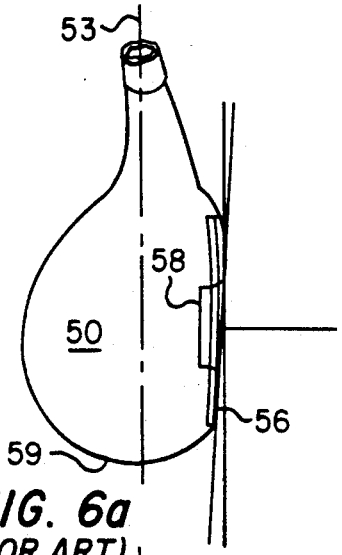
FIG. 6a (PRIOR ART)
FIGS. 6*a*-6*c* are plan views of the prior art wooden golf club heads showing typical open, even and closed face orientations, respectively.
Figure 7A:
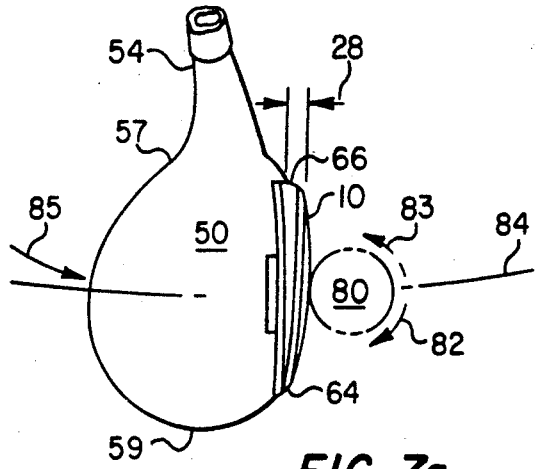
FIGS. 7*a*-7*c* are plan views of the wooden golf club of FIG. 1, installed with a shield constructed in accordance with this invention and showing three alternate embodiments of the metallic shield with hook and slice tendency variations.
Figure 6B:
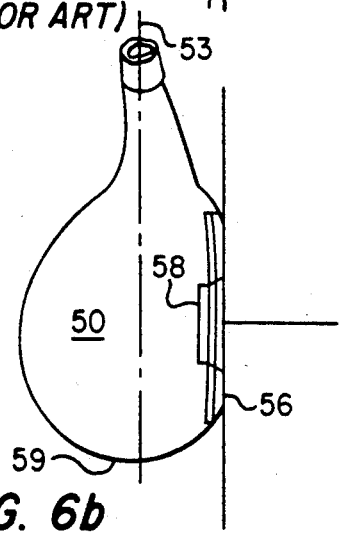
FIG. 6b (PRIOR ART)
Figure 7B:
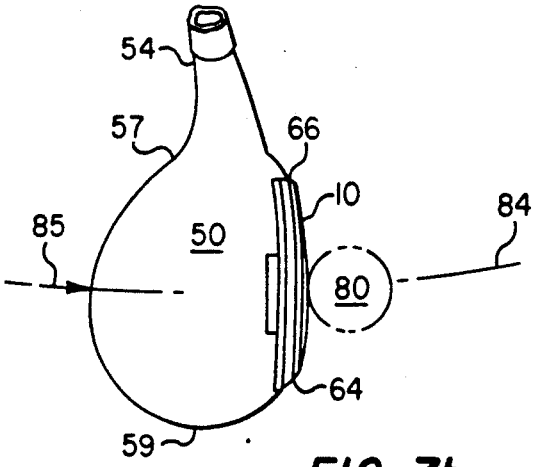
Figure 6C:
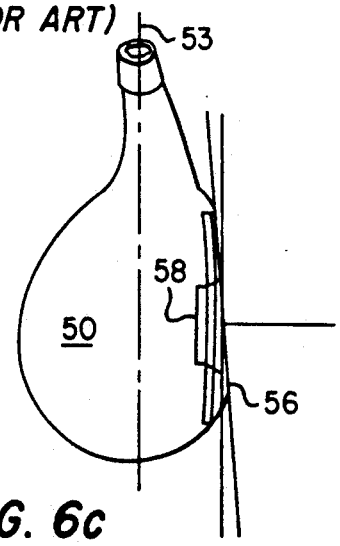
FIG. 6c (PRIOR ART)
Figure 7C:
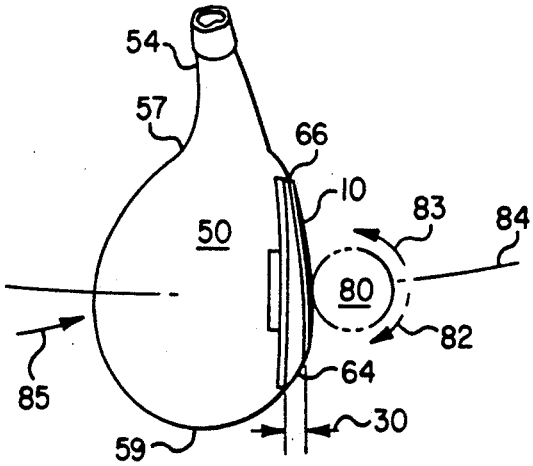

Referring now to the figures, wherein numerals indicate parts that are the same throughout all views, a golf club head 50 is shown having a shaft 52, a hosel 54, a heel 57, a sole 60, and a toe 59. The sole 60 has a planar bottom and a slight upward curvature at its end nearest the toe 59. The club head 50 further has a face 56, with an insert 58 therein. Horizontal grooves 16 extend from the heel 57 to the toe 59 across the face 56 and the insert 58. A sweet spot 62 is located approximately in the middle of the insert 58. The face 56 of the club head 50 has a non-vertical tilt relative to the bottom of the sole 60, the tilt defining a loft angle 25 characteristic shown graphically in FIG. 5 as angular displacement "$\alpha$" from vertical. The face 56 of the club head 50 is not flat but is slightly bulged and rolled to an apex at the sweet spot 62.

The illustrated embodiment of the present invention, comprising a shield 10 and a bonding layer 40 (FIG. 2), fits over the face 56 of the club head 50, substantially covering it. Most preferably, the shield 10 completely covers the face 56. Though the illustrated club head 50 shows an insert 58, as though the shield 10 is to be fitted to an existing club, the club head 50 can just as well be a new club head blank in preparation for manufacture of a new golf club. In such case, the insert 58 and the grooves 16 would not be present.

As illustrated in FIGS. 3*b* and 3*c*, the shield 10 further comprises a bulge 22 (FIG. 3*b*) and a roll 23 (FIG. 3*c*) that reflect the bulge and roll of the club head 50 being modified. This may vary from one manufacturer to another, but, as discussed earlier, each typically has a radius of approximately 10 inches. The shield 10 is preferably metallic, and may be made from a variety of resilient metals which have the necessary mechanical stability characteristic for the purposes of the present invention. Such mechanical stability requirements include enough elasticity to return to its prefabricated shape after impact with a ball, and to retain shape during transportation, storage and installation. Typically, the shield 10 is made of aluminum, though other metals may serve as well and provide alternative impact resiliency options for controlling the hitting characteristics of the club face 56. To increase the friction of the shield 10, its front face 12 may be provided with horizontal grooves 17 in keeping with the grooves 16 typically provided on the face 56 of a wooden club.

In a preferred embodiment of the present invention, a plurality of fasteners 18, typically screws, penetrate through the shield 10 and into the face 56 to secure the shield 10 in position. The number and arrangement of the fasteners 18 is not critical, requiring only that a sufficient number be evenly distributed over the face 56 to secure all portions of the shield 10 to the face 56. Typically, a minimum of four, up to a maximum of eight, fasteners 18 may be used, the number used depending upon whether or not a bonding layer 40 having adhesive characteristics also is sandwiched between the shield 10 and the face 56, as the use thereof permits fewer fasteners 18.

In another preferred embodiment of the present invention, a bonding layer 40 is interstitially encased between the shield 10 and the face 56 of the club head 50 as illustrated in FIG. 2. The bonding layer 40 comprises an outer border which coincides with the outer border of the shield 10 and completely covers the face 56 beneath the shield 10. The bonding layer 40 is applied in liquid or semi-viscous or gelatinous form and permitted to harden in place after the shield 10 is installed thereon.

The bonding layer 40 can theoretically be of any material capable of bonding with the metallic shield 10 and the face 56 which has the necessary mechanical and dimensional stability requirements for the purposes of the present invention. However, certain preferred bonding layers have been found to work most advantageously. Preferably, the bonding layer 40 is a thermosetting resin capable of bonding a metallic plate to wood or other materials. The most preferred thermosetting resins are epoxy resins made by reacting epichlorohydrin with a polyhydroxy compound such as bisphenol A in the presence of a catalyst. Epoxy resins produced in this way are known in the art as diglycidyl ethers of bisphenol A.

A number of epoxy based thermosetting resins can be used as adhesives for bonding dissimilar materials such as wood and metal. Commercially available epoxy adhesives include one or two part systems. The one part systems generally require curing at elevated temperatures, while the two part systems can usually be cured at room temperatures and are therefore preferred. Commercially available epoxy adhesives which have proved successful for purposes of the present invention include the N-butyl glycidyl ethers sold as the 932D and 934D compounds of Fenwall, Inc. of Ashland, Mass., and an epoxy resin sold as the EPOWALD 3243-A by Hardman, Inc., of Belleville, New Jersey.

The best mode of operation of the present invention relies upon both a bonding layer 40 and securing screws serving as fasteners 18. While the bonding layer 40 typically has adhesive characteristics that provide shear strength to resist movement between the face 56 and the shield 10, the best mode also relies upon four to six screws serving as fasteners 18, to supplement such shear strength. The bonding layer 40 fills cracks, grooves and voids in the face 56, hardens to create a resilient cushioning layer between the face 56 and the shield 10, and contributes shear strength to supplement the shear strength derived from the fasteners 18. Drilling to install the fasteners 18, with concomitant risk of splitting the club head 50, is thereby minimized.

FIGS. *3a*, *3b*, *3c* and *4a* reveal a shield 10 of uniform thickness, from the sole edge 68 to the top edge 67 and from the heel edge 66 to the toe edge 64. Shields having a thickness gradient, or uniform change in thickness, from the top edge 67 to the sole edge 68 permit alteration of the loft characteristic $\alpha$ of the face 56, thereby increasing or decreasing the loft angle 25 as shown in FIGS. *4b* and *4c*. In FIG. *4b*, the sole edge 68 of the shield 10 shows a lower thickness 24 greater than the corresponding upper thickness 26 of the top edge 67 in FIG. *4b*. This causes the front face 12 of the installed shield 10 to be inclined more than that of the face 56 before the shield 10 was installed. Likewise, in FIG. *4c*, the loft angle 25 of the club 50 can be decreased by installing a shield 10 having the thickness gradient that decreases from the top edge 67 to the sole edge 68. This gradient causes the front face 12 to be closer to vertical than the loft angle 25 of the face 56 before installation of the shield 10.

Correction of tendencies of a club head 50 to cause hooks or slices is illustrated in FIGS. *7a–7c*. FIGS. *6a–6c*, respectively, illustrate open faced, parallel faced and closed faced clubs according to the prior art. The face 56 in FIG. *6b* is parallel to the unflexed shaft axis 53, while the face 56 in FIGS. *6a* and *6c* is, respectively, closer to and further from the shaft axis 53 at the toe 59 end of the club head 50. As illustrated in FIGS. *7a–7c*, the same effect results from installation of a shield 10 of appropriate thickness gradient from its heel edge 66 to its toe edge 64.

As the club head 50 travels along its swing path 85, which supposedly tracks the intended travel path 84 of the ball 80, it strikes the ball 80 at or near the sweet spot 62. With the shield 10 in place as in FIG. *7a*, a shift in the plane defined by the front face 12, counteracts a tendency of the club head 50 to induce a hooking spin 83 on the ball 80 when the swing path 85 crosses the travel path 85 from the side nearest the heel 57 toward the side nearest the toe 59. This is achieved by providing a shield 10 as in FIG. *7a* having a thickness gradient heel 57 to toe 59, thus having heel thickness 28 at its heel edge 66 greater than the corresponding toe thickness 30 at the toe edge 64. The opposite effect results from the opposite thickness gradient, as in FIG. *7c*, wherein a shield 10 is provided having a toe thickness 30 at its toe edge 64 greater than the heel thickness 28 at its heel edge 66. This difference counteracts a tendency of the club 50 to induce a slicing spin 82 on the ball 80. An array of shields may be provided for selection of the appropriate amount of toe thickness 30 or heel thickness 28 as required.

In operation, a golf club repairman or manufacturer would have available to him an array of shields from which to choose to achieve a variety of different loft, hook and slice characteristics. If simple repair is required, a shield 10 of uniform thickness (zero thickness gradient) would be needed. A selection would be provided, each member thereof having a rear face 14 reflecting the curvature, or bulge 22 (FIG. *3b*) and roll 23 (FIG. *3c*), of the club head 50 to be repaired. If the repairer needs to alter the hook or slice tendencies of the club head 50, he would choose a shield 10 having additionally a toe 59 to heel 57 thickness gradient (FIGS. *7a* and *7c*). Should the repairer wish to counteract a tendency of the golf club to cause a slice, then the repairer would select a shield 10 as in FIG. *7c* having a toe thickness 30 greater than the heel thickness 28, thereby skewing the orientation of the front face 12 to counteract horizontal spin 82. Conversely, if the repairer wishes to counteract the tendency of the golfer to hook the ball, he would select a shield 10 as in FIG. *7a* having a heel thickness 28 greater than the toe thickness 30. To alter loft characteristics, the repairer would select a shield 10 as in FIGS. *4b* and *4c* having additionally a lower thickness 24 greater than its upper thickness 26, for a greater loft angle 25 (FIG. *4b*), or having a greater upper thickness 26 to reduce the loft angle 25 (FIG. *4c*).

The shield 10 of the invention and the method of its use provide advantages in repair of wooden golf clubs and in tailoring or adjusting the hitting characteristics of existing golf clubs. Rather than discarding a wood that suffers from erosion or nicks on its face, a golfer can engage a repairer to install a shield 10 over the face 56. The shield 10 thereby provides a relatively quick and easy means of giving the golfer a new golf club with hitting characteristics of the metallic shield 10 replacing the hitting characteristics of the insert 58. Should that golfer also wish to alter the loft, slice or hook tendencies of his club head 50, he could request that the repairer select a shield 10 that so alters the club as described above.

Original club manufacturers can utilize shields to define loft, hook or slice characteristics of original equipment clubs. Having available a single shield 10 that attaches to the face of a wooden club head blank permits a club manufacturer to set a hosel drill at a fixed angle relative to the prefabricated face 56, thereby determining one of three dimensions which must be defined before drilling. Once the hosel 54 has been drilled, the face 56 can be adjusted for hook, slice or loft alterations using the appropriate shield 10. Such a feature separates the face 56 adjustment step from that of the shaft 52 installation, leaving only the drilling depth and the "lie" angle between the shaft 52 and the sole 60, a characteristic defined primarily by the golfer's stature. Such step segregation greatly simplifies the hosel 54 drilling and shaft 52 installation.

In any case, the repairer or manufacturer would secure the shield 10 to the face 56, either by using an adhesive bonding layer 40, or, in addition thereto, or in lieu thereof, the shield can be secured with fasteners 18. After installation, the shield and bonding layer would be filed down and the shape otherwise adjusted at its perimeter to smoothly integrate with the surface of the club head 50 for aesthetic appeal.

In both the repair and original equipment manufacturing situations, an array of ready-made face plates designed for incremental changes to the loft, hook and slice characteristics of each club lend speed and consistency to a process that otherwise requires either sophisticated and expensive equipment or trial and error efforts of a skilled craftsman. Such devices relieve the need for sanding the face 56 to effect such alterations, and, in the case of manufacturing, greatly simplify drilling the hosel.

The invention has been shown in only one of its forms. It should be apparent to those skilled in the art that it is not so limited, but is susceptible to various changes and modifications without departing from the spirit thereof. For example, the discussion has generally focused upon wooden heads historically used in manufacture of, and obviously contributing to the name of, golf clubs known as woods. Today, however, woods are fabricated from other materials, commonly metal or some combination of metal and wood or other materials. The present invention should be equally useful in all such applications.

What I claim is:

1. A shield assembly for covering a face of a golf club which has a curved face with a bulge and roll, comprising:

a plate having a curved rear face with a shape adapted to approximate the bulge and roll and size of the face of the golf club; and fastening means comprising a plurality of fasteners having retaining heads, the fasteners adapted to penetrate into the face of the golf club through the plate for securing the plate to the face of the golf club.

2. The shield assembly for covering a face of a golf club according to claim 1 and further comprising:

a bonding layer substantially covering the face of the club and sandwiched between the plate and the face of the golf club.

3. The shield assembly for covering a face of a golf club according to claim 2 wherein:

the bonding layer comprises a thermosetting resin.

4. The shield assembly for covering a face of a golf club according to claim 2 wherein:

the bonding layer comprises an epoxy resin prepared by reacting epichlorohydrin with a polyhydroxy compound in the presence of a catalyst.

5. The shield assembly for covering a face of a golf club according to claim 1 wherein:

the plate has a front face, a top edge and a sole edge, and wherein the front face comprises a plurality of lateral grooves substantially parallel to each other and to the sole edge of the plate for increasing friction on the contact surface.

6. The shield assembly for covering a face of a golf club according to claim 1 wherein:

the metallic plate has a top edge and a sole edge opposite the top edge, the metallic plate further comprising a thickness gradient of uniform change in thickness from the top edge to the sole edge for varying the loft of the face of the wooden golf club when the shield is affixed thereto.

7. The shield assembly for covering a face of a golf club according to claim 6 wherein:

the sole edge is thicker than the top edge for increasing the loft of the face of the golf club.

8. The shield assembly for covering a face of a golf club according to claim 6 wherein:

the top edge is thicker than the sole edge for decreasing the loft of the face of the golf club.

9. The shield assembly for covering a face of a golf club according to claim 1 wherein:

the plate further comprises a front face, a toe edge and a heel edge opposite the toe edge, the metallic plate further comprising a thickness gradient of a uniform change in thickness from the toe edge to the heel edge for varying an orientation of the front face relative to the face of the golf club when the shield is affixed thereto.

10. The shield assembly for covering a face of a golf club according to claim 9 wherein:

the toe edge is thicker than the heel edge for offsetting a tendency of the golf club to induce a slice into the flight path of a golf ball.

11. The shield assembly for covering a face of a golf club according to claim 9 wherein:

the heel edge is thicker than the toe edge for offsetting a tendency of the golf club to induce a hook into the flight path of a golf ball.

12. A shield assembly for covering a face of a golf club, the face of the golf club having a curved shape with a bulge and roll, the shield assembly comprising:

a plate having a shape adapted to approximate the shape and size of the face of the golf club and having a curved rear face adapted to approximate the bulge and roll of the face of the golf club;

a bonding layer located between the rear face of the plate and the face of the golf club, the bonding layer substantially covering the face of the golf club; and fastening means for attaching the plate and the bonding layer to the face of the golf club.

13. The shield assembly for covering the face of a golf club according to claim 12 wherein:

the fastening means comprises a plurality of fasteners having retaining heads, the fasteners adapted to penetrate into the face of the golf club through the plate and the bonding layer.

14. The shield assembly for covering the face of a golf club according to claim 12 wherein:

the fastening means comprises adhesive characteristics of the bonding layer sufficient to bond the plate to the face.

15. An improved golf club comprising in combination:

a golf club known as a wood, the golf club having a head with a face which includes an insert having a plurality of parallel grooves formed therein, the face being curved and having a bulge and roll; and a shield assembly for attaching to and covering the face and the insert of the golf club, the shield assembly further comprising:

a plate having a front face, a rear face, a top edge, a sole edge opposite the top edge, a toe edge, and a heel edge opposite the toe edge, the rear face having a curved shape adapted to approximate the bulge and roll and size of the face and insert of the golf club; and a bonding layer of a nonmetallic material sandwiched between the rear face of the plate and the face of the golf club.

16. The improved golf club according to claim 15 wherein:

the plate further comprises a thickness gradient of uniformly changing thickness from the sole edge to the top edge for changing a vertical angle of the face of the golf club when the shield is affixed thereto for improving loft characteristics of the golf club.

17. The improved golf club according to claim 15 wherein:

the plate further comprises a thickness gradient of uniformly changing thickness from the toe edge to the heel edge for changing a horizontal angle of the face of the golf club when the shield is affixed thereto for improving hook and slice tendency characteristics of the golf club.

18. The improved golf club according to claim 15 wherein:

the bonding layer comprises an epoxy resin prepared by reacting epichlorohydrin with a polyhydroxy compound in the presence of a catalyst.

19. The improved golf club according to claim 15 wherein:

the bonding layer comprises a thermosetting resin.

20. The improved golf club according to claim 15 and further comprising:

a plurality of fasteners having retaining heads and adapted to penetrate into the face of the golf club through the plate and the bonding layer for securing the plate and the bonding layer to the face of the golf club.

21. A method for improving a golf club comprising:

providing a golf club of the type known as a wood to be improved, the golf club having a face containing a plurality of parallel grooves and a bulge and roll;

determining improvement characteristics to be made to the golf club, including changes to at least one or more of loft, hook and slice characteristics thereof and repair of damaged locations on a face of the golf club;

providing a plurality of shield assemblies for attaching to a face of golf clubs, each shield assembly comprising a plate having a curved rear face shaped to approximate the bulge and a roll of the face of the golf club, the plate further comprising a thickness gradient from one edge to an opposing edge for establishing a pre-determined angle of the face of the golf club when the shield is affixed thereto, the shield assembly further comprising a fastening means for attaching the plate to the face; then selecting one of the shield assemblies provided to achieve the determined improvement characteristics sought for the golf club; then securing the shield assembly to the face of the golf club, covering the grooves of the face of the golf club, and adjusting the shape of the shield assembly as installed for smoothness and appearance.

22. A method for manufacturing a new golf club comprising:

providing a blank head for a golf club commonly referred to as a wood; the blank head having a prefabricated hosel and a curved face with a bulge and a roll;

determining intended hook, slice and loft characteristics for a finished golf club to be fabricated from the blank head;

installing a shaft for the golf club;

providing a plurality of shield assemblies for attaching to a face of a golf club, each shield assembly comprising a fastening means and plate having a curved rear face shaped to approximate the bulge and the roll of the blank head, the plate further comprising a thickness gradient from one edge to an opposing edge for establishing an angle of the face of the finished golf club when the shield is affixed thereto, the shield assembly further comprising a fastening means for attaching the plate to the face; then selecting one of the shield assemblies provided to achieve the determined characteristics sought for the gold club; then installing the shield assembly to the face of the golf club and adjusting the shape of the shield assembly as installed for smoothness and appearance.

* * * * *